US008339058B2

(12) United States Patent
Simmers

(10) Patent No.: US 8,339,058 B2
(45) Date of Patent: Dec. 25, 2012

(54) THREE-COLOR RGB LED COLOR MIXING AND CONTROL BY VARIABLE FREQUENCY MODULATION

(75) Inventor: Charles R. Simmers, Phoenix, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 261 days.

(21) Appl. No.: 12/623,657

(22) Filed: Nov. 23, 2009

(65) Prior Publication Data

US 2010/0148676 A1 Jun. 17, 2010

Related U.S. Application Data

(60) Provisional application No. 61/121,969, filed on Dec. 12, 2008.

(51) Int. Cl.
*H05B 41/16* (2006.01)

(52) U.S. Cl. ..... 315/246; 315/152; 315/250

(58) Field of Classification Search ..... 315/149, 315/152, 155, 159, 246, 291, 307–308, 312
See application file for complete search history.

(56) References Cited

U.S. PATENT DOCUMENTS

| | | | | |
|---|---|---|---|---|
| 6,377,236 | B1 * | 4/2002 | Karamoto | 345/102 |
| 7,315,139 | B1 | 1/2008 | Selvan et al. | 315/291 |
| 2004/0135524 | A1 * | 7/2004 | Gunter et al. | 315/291 |
| 2005/0122065 | A1 | 6/2005 | Young | 315/294 |
| 2007/0052375 | A1 * | 3/2007 | Lin et al. | 315/312 |
| 2007/0103086 | A1 | 5/2007 | Neudorf et al. | 315/149 |
| 2007/0205969 | A1 * | 9/2007 | Hagood et al. | 345/84 |
| 2008/0180040 | A1 * | 7/2008 | Prendergast et al. | 315/297 |
| 2008/0297066 | A1 * | 12/2008 | Meijer et al. | 315/291 |
| 2011/0013414 | A1 * | 1/2011 | Smithson | 362/554 |

FOREIGN PATENT DOCUMENTS

| | | | |
|---|---|---|---|
| WO | 2004/057923 | A1 | 7/2004 |
| WO | 2008/056321 | A1 | 5/2008 |

OTHER PUBLICATIONS

International PCT Search Report, PCT/US2009/067652, 14 pages, Mailed Mar. 18, 2010.

* cited by examiner

*Primary Examiner* — Tung X Le
(74) *Attorney, Agent, or Firm* — King & Spalding L.L.P.

(57) ABSTRACT

Perceived output color and intensity (brightness) of light from a three-element red-green-blue (RGB) light emitting diode (LED) or optical combination of three LEDs (red, green and blue) are controlled with three pulse train signals, each having fixed pulse width and voltage amplitude and then increasing or decreasing the frequency (increasing or decreasing the number of pulses over a time period) of these pulse train signals so as to vary the average current through each of the RGB-LEDs. This reduces the level of electro-magnetic interference (EMI) at any one frequency by varying the pulse train energy spectrum over a plurality of frequencies.

20 Claims, 6 Drawing Sheets

THREE-COLOR RGB LED COLOR MIXING AND CONTROL BY VARIABLE FREQUENCY MODULATION

RELATED PATENT APPLICATIONS

This application claims priority to commonly owned U.S. Provisional Patent Application Ser. No. 61/121,969; filed Dec. 12, 2008; entitled "Three-Color RGB Led Color Mixing and Control by Variable Frequency Modulation," by Charles R. Simmers; and is related to U.S. patent application Ser. No. 12/576,346; filed Oct. 9, 2009; entitled "LED Intensity Control by Variable Frequency Modulation," by Charles R. Simmers; wherein both are hereby incorporated by reference herein for all purposes.

TECHNICAL FIELD

The present disclosure relates to controlling light emitting diodes (LEDs), and more particularly, to controlling the perceived color and intensity (brightness) of a three-element red-green-blue (RGB) LED combination by having three channels of fixed pulse width and fixed voltage signals, and increasing or decreasing each frequency thereof to vary the average current across each of the three LED elements (RGB).

BACKGROUND

Pulse width modulation (PWM) is a known technology to control LED intensity. However, implementation of a PWM methodology to control LED color and intensity (brightness) has been shown to sometimes be problematic in some applications that are sensitive to radiated noise emissions and/or flicker.

SUMMARY

What is needed is a way to vary the perceived output color and intensity (brightness) of a three-element RGB LED while minimizing radiated noise emissions and flicker. Variable frequency modulation (VFM) offers an alternative process to controlling the intensities of the three red-green-blue (RGB) LEDs that may be easier for an end-user to implement, based on their particular system requirements. The resulting three channels of drive signals (RGB) exhibit both lower power requirements, as well as lower EMI radiation then prior technology PWM designs.

According to the teachings of this disclosure, the perceived color and intensity (brightness) of a three-element RGB LED and/or optical combination of three LEDs (red, green and blue) may be controlled by using three pulse train signals, each having fixed pulse width and voltage amplitude, and then increasing or decreasing the frequency (increasing or decreasing the number of pulses over a time period) of these pulse train signals so as to vary the average current through each of the LEDs (RGB). This reduces the level of electromagnetic interference (EMI) at any one frequency by varying the pulse train energy spectrum over a plurality of frequencies.

According to a specific example embodiment of this disclosure, an apparatus for controlling brightness and color from a grouping of red, green and blue light emitting diodes (LEDs) comprises: red, green and blue pulse generating circuits having trigger inputs and pulse outputs, wherein a plurality of trigger signals are applied to each of the trigger inputs and a plurality of pulses therefrom are generated at each of the red, green and blue pulse outputs, wherein each of the plurality of pulses has a constant width and amplitude; red, green and blue pulse on-time integrators, each having a pulse input coupled to a respective pulse output of the red, green and blue pulse generating circuits and an integration time interval input, wherein the red, green and blue pulse on-time integrators generate output voltages proportional to percentages of when the amplitudes of the plurality of pulses for each of the red, green and blue pulse outputs are on over an integration time interval; red, green and blue operational amplifiers, each having negative and positive inputs and an output, each of the negative inputs is coupled to the output voltage from a respective one of the red, green and blue pulse on-time integrators and each of the positive inputs of the red, green and blue operational amplifiers is coupled to voltage signals representing desired color and light brightness from red, green and blue light emitting diodes (LEDs); and red, green and blue voltage controlled frequency generators having frequency control inputs and frequency outputs, wherein each of the frequency control inputs is coupled to a respective output of the red, green and blue operational amplifiers, and the frequency outputs generating the plurality of the trigger signals are coupled to the trigger inputs of the red, green and blue pulse generating circuits, whereby the red, green and blue voltage controlled frequency sources cause the red, green and blue pulse generating circuits to produce the plurality of pulses necessary for producing the desired color and light brightness from the red, green and blue LEDs.

According to another specific example embodiment of this disclosure, an apparatus for controlling brightness and color from a grouping of red, green and blue light emitting diodes (LEDs) comprises: red, green and blue pulse generating circuits having trigger inputs and pulse outputs, wherein a plurality of trigger signals are applied to each of the trigger inputs and a plurality of pulses therefrom are generated at each of the red, green and blue pulse outputs, wherein each of the plurality of pulses has a constant width and amplitude; a light brightness detector adapted to receive colored light from red, green and blue light emitting diodes (LEDs) and output a voltage proportional to the color light brightness therefrom; a brightness control operational amplifier having a negative input coupled to the light brightness detector and a positive input coupled to a voltage signal representing a desired color light brightness from the red, green and blue LEDs; red, green and blue gain controlled amplifiers, each having a respective signal input coupled to red, green and blue control signals representing desired color and light brightness from the red, green and blue light LEDs, and a gain control input coupled to an output of the brightness control operational amplifier; and red, green and blue voltage controlled frequency generators having frequency control inputs and frequency outputs, wherein each of the frequency control inputs is coupled to a respective output of the red, green and blue gain controlled amplifiers, and the frequency outputs generating the plurality of the trigger signals are coupled to the trigger inputs of the red, green and blue pulse generating circuits, whereby the red, green and blue voltage controlled frequency sources cause the red, green and blue pulse generating circuits to produce the plurality of pulses necessary for producing the desired color and light brightness from the red, green and blue LEDs.

According to yet another specific example embodiment of this disclosure, a microcontroller for controlling brightness and color from a grouping of red, green and blue light emitting diodes (LEDs) comprises: a microcontroller having red, green and blue outputs, a brightness control input and red, green and blue control inputs, the red, green and blue outputs are coupled to a red, green and blue light emitting diodes (LEDs), the brightness control input is coupled to a color light brightness control signal and the red, green and blue control inputs are coupled to red, green and blue control signals; and the microcontroller generates a plurality of red, green and blue pulses, wherein each of the plurality of red, green and blue pulses has a constant width and amplitude, and light brightness from each of the red, green and blue LEDs is proportional to a percent of time that the plurality of constant width and amplitude red, green and blue pulses are on over an integration time interval.

BRIEF DESCRIPTION OF THE DRAWINGS

A more complete understanding of the present disclosure may be acquired by referring to the following description taken in conjunction with the accompanying drawings wherein.

Figure 1:
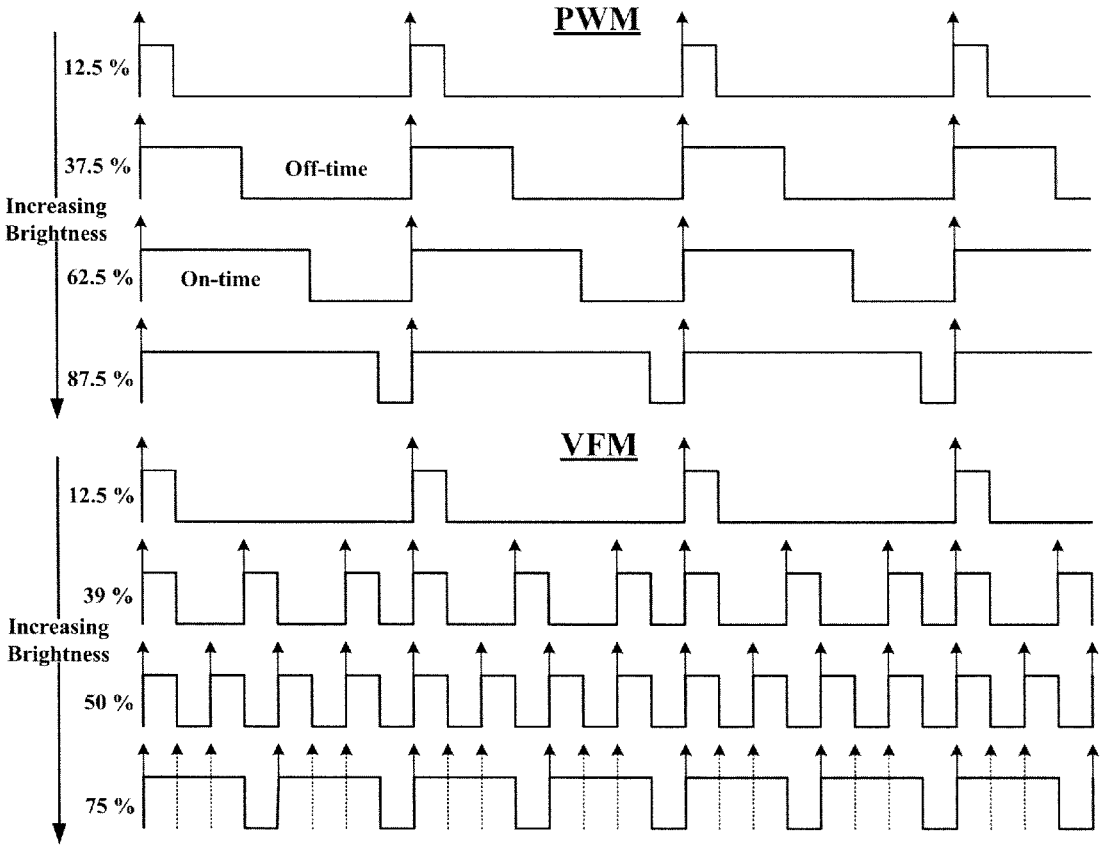
FIG. 1 are schematic timing diagrams of pulse width modulation (PWM) drive signals for comparison with variable frequency modulation (VFM) drive signals for controlling the percent brightness of a light emitting diode (LED), according to the teachings of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawing, the details of specific example embodiments are schematically illustrated. Like elements in the drawings will be represented by like numbers, and similar elements will be represented by like numbers with a different lower case letter suffix.

Referring to FIG. 1, depicted is a schematic block diagram of pulse width modulation (PWM) drive signals for comparison with variable frequency modulation (VFM) drive signals for controlling the percent brightness of a light emitting diode (LED), according to the teachings of this disclosure. PWM pulse trains are shown for LED brightness levels of 12.5, 37.5, 62.5 and 87.5 percent. The brightness level percentages correspond to the percentages that the PWM pulse train is at a logic high, i.e., "on," thereby supplying current into the LED (see FIG. 3). The PWM pulse train comprises the same time interval (frequency) between the start of each PWM pulse (indicated by vertical arrows) and varies the "on" time of each of the pulses so as to obtain the desired LED brightness level. This PWM LED intensity control method works but causes concentrated EMI at one frequency over time which may result in a product not meeting strict European and/or USA EMI emission limitations.

According to the teachings of this disclosure, variable frequency modulation (VFM) is used for controlling LED light brightness while reducing EMI generated at any one frequency. VFM pulse trains are shown for LED brightness levels of 12.5, 39, 50 and 75 percent. The brightness level percentages correspond to the percentages that the VFM pulse train is at a logic high, i.e., "on," over a certain time interval (user selectable), thereby supplying current into the LEDs (see FIG. 3). The VFM pulse train comprises a plurality of pulses, each pulse having the same pulse width ("on" or logic high time duration), that may occur over various time intervals (i.e., various frequencies). The start of each pulse is represented by a vertical arrow. Thus LED intensity may be controlled by adjusting how many VFM pulses occur over the certain time intervals. Granularity of the light brightness control may be improved by using shorter pulse widths (logic high time durations) and thereby more pulses per time interval. The end result in controlling the LED light brightness is the percent that the pulses are "on" during each time interval.

Figure 2:
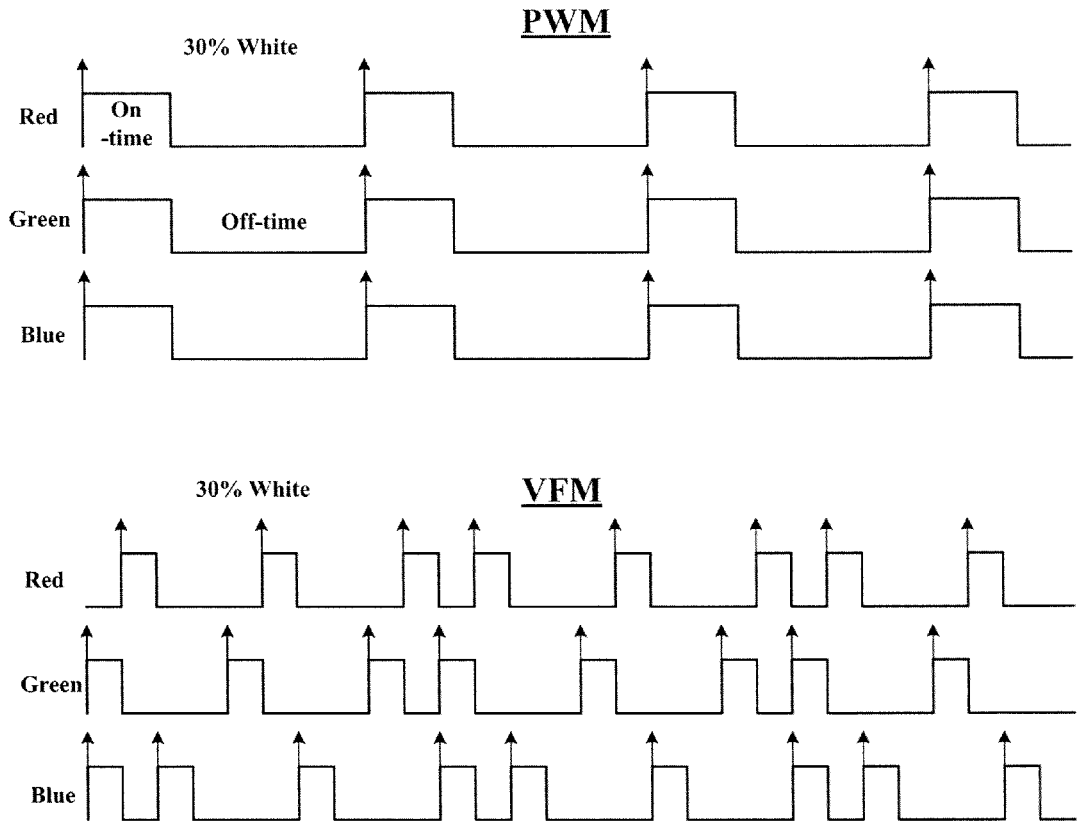
FIG. 2 are schematic timing diagrams of pulse width modulation (PWM) drive signals for comparison with variable frequency modulation (VFM) drive signals for controlling the color of light from a three-element red-green-blue (RGB) LED combination, according to the teachings of this disclosure.

Referring to FIG. 2, depicted are schematic timing diagrams of pulse width modulation (PWM) drive signals for comparison with variable frequency modulation (VFM) drive signals for controlling the color of light from a three-element red-green-blue (RGB) LED combination, according to the teachings of this disclosure. When equal light intensity (brightness) from red, green and blue (RGB) LEDs are grouped together in a tri-pixel relationship, the resulting LED red-green-blue color mix produces white light. Other colors may be produced by varying the light intensity relationships between the tri-pixel RGB LEDs.

When using PWM for color control of the tri-pixel RGB LEDs, the color white requires that each of the RGB LEDs have the same intensities at their respective red, green and blue colors (assuming that all three RGB LEDs have the same light output for a given current). Thus the three channels of PWM drive signals all must be at the same frequency and pulse width. When colors are to be changed in a PWM drive system, the PWM pulse widths change to produce the desired color mix from the three RGB LEDs. This operations produces very high level EMI at the PWM frequency.

The variable frequency modulation (VFM) on the other hand can produce fixed width and amplitude pulses at a plurality of different and widely varying frequencies so as to reduce the radio frequency noise power at any one frequency, as is the case when using PWM to drive the RGB LEDs.

Figure 3:
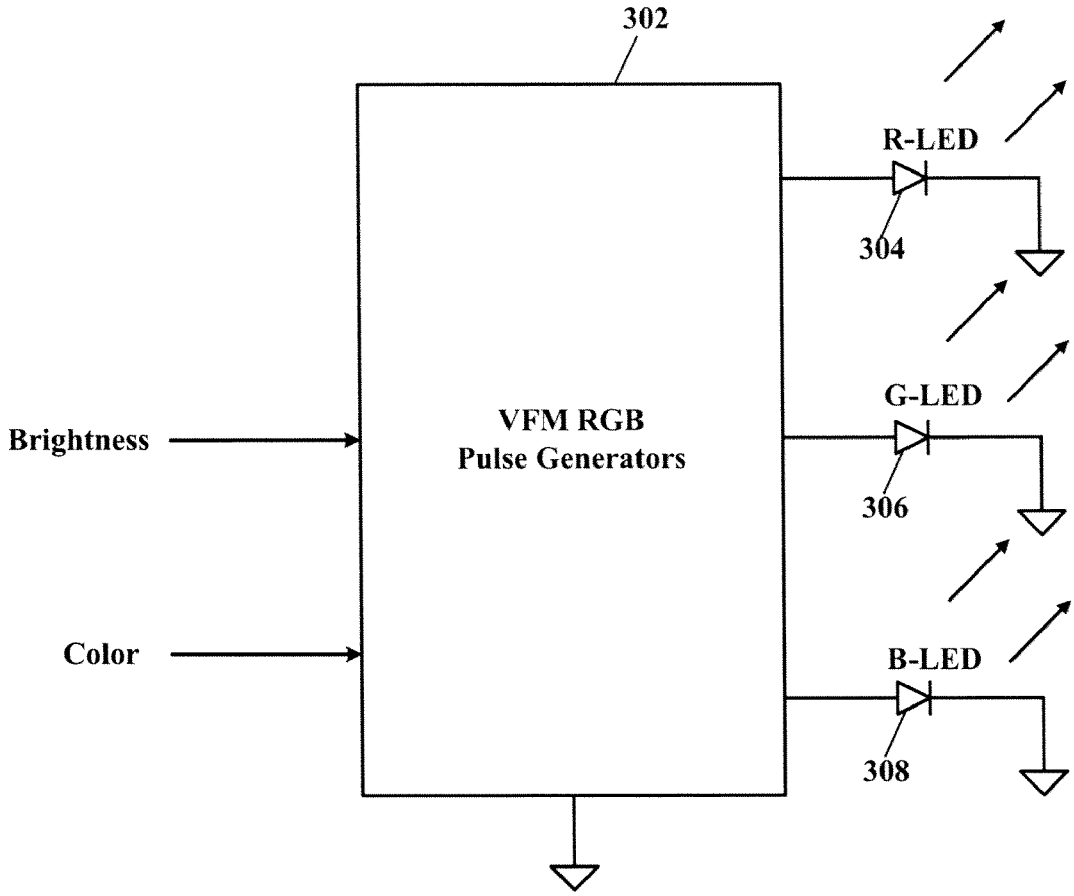
FIG. 3 is a schematic block diagram of variable frequency modulation (VFM) pulse generators driving a three-element RGB-LED combination, according to the teachings of this disclosure.

Referring to FIG. 3, depicted is a schematic block diagram of variable frequency modulation (VFM) pulse generators driving a three-element RGB-LED combination, according to the teachings of this disclosure. VFM RGB pulse generators 302 comprise three independent VFM pulse train outputs. Each of the VFM pulse train outputs drives a respective one of the red LED 304, green LED 306 and blue LED 308 to a desired light brightness to produce a desired light color. Light brightness and color control signals indicate to the VFM RGB pulse generators 302 what light brightness and color are desired. The VFM pulse trains may independently vary from no pulses per time interval (zero percent light brightness) to 100 percent on per time interval (maximum light brightness), and a number of pulses per time interval less than the number of pulses for 100 percent on time. Thus by controlling the VFM pulse trains to the red LED 304, the green LED 306 and the blue LED 308, desired light intensities and colors are thereby achieved.

Figure 4:
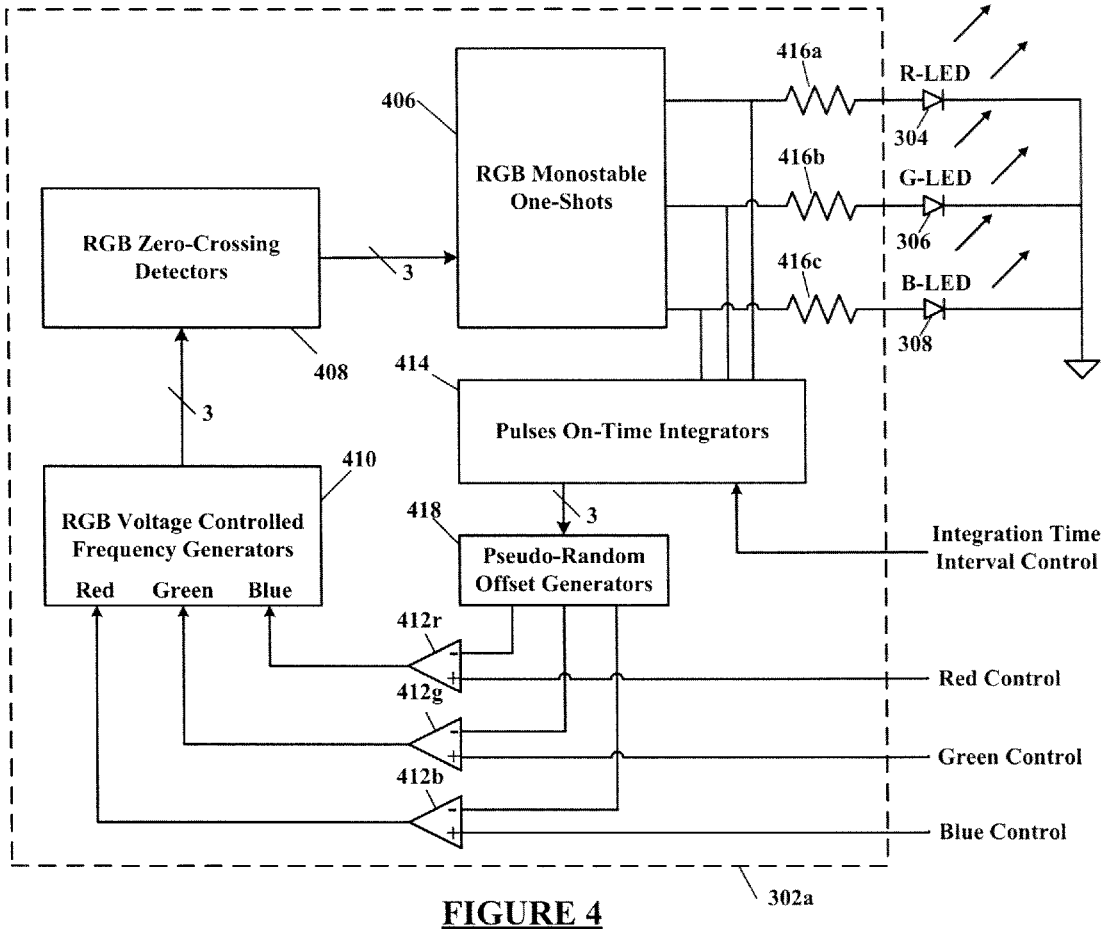
FIG. 4 is a schematic block diagram of VFM pulse generators driving a three-element RGB-LED combination, according to a specific example embodiment of this disclosure.

Referring to FIG. 4, depicted is a schematic block diagram of VFM pulse generators driving a three-element RGB-LED combination, according to a specific example embodiment of this disclosure. VFM pulse generators 302*a* comprise RGB monostable one-shots 406 having fixed pulse width (logic high time duration) outputs, pulses on-time integrators 414, operational amplifiers 412 having differential inputs, voltage controlled frequency generators 410, and zero-crossing detectors 408. Each of the one-shots 406 is "fired" (output goes to a logic high for the fixed time duration) whenever a start pulse at its respective input is detected. These start pulses are supplied from the zero-crossing detectors 408 at repetition rates (pulses per time duration) which are determined from the frequencies of the voltage controlled frequency generators 410. The voltage controlled frequency generators 410 may be voltage controlled oscillators (VCOs), voltage-to-frequency converters, etc. Resistors 416 may be used to control the amount of current to the red LED 304, the green LED 306 and the blue LED 308.

The output signal frequencies from the voltage controlled frequency generators 410 are controlled by voltages from the respective operational amplifiers 412. The operational amplifiers 412 compare red, green and blue light brightness voltage inputs with respective voltages from the pulse on-time integrators 414. The voltages from the pulse on-time integrators 414 are representative of the percent that the outputs of the one-shots 406 are on during the certain time durations. The operational amplifiers 412 have gain and will cause the voltage controlled frequency generators 410 to adjust their frequencies so that the "on" times of the VFM pulse trains over a certain time duration equals the red, green and blue light brightness voltage inputs (voltage levels configured to be proportional to the percent of each light brightness desired for the respective red LED 304, green LED 306 and blue LED 308. This arrangement produces independent closed loop brightness control of the red LED 304, green LED 306 and blue LED 308.

According to the teachings of this disclosure, an optional further feature may use pseudo random offset generators 418 to introduce random voltage perturbations at the voltage inputs of the voltage controlled frequency generators 410. These random voltage perturbations may further spread EMI noise power over a greater (wider) number of frequencies, and thus reduce the EMI noise power at any one frequency. This is very advantageous when having to meet strict EMI radiation standards. The pseudo random offset generators 418 may be coupled between the pulse on-time integrators 414 and the operational amplifiers 412, between the red, green and blue light brightness inputs and the operational amplifiers 412, or between the outputs of the operational amplifiers 412 and the voltage inputs of the voltage controlled frequency generators 410. The pseudo-random offset generators 418 may provide additional frequencies to those frequencies resulting from the combination of the light brightness closed loop controls and outputs from the pulse on-time integrators 414.

It is contemplated and within the scope of the disclosure that the light intensity inputs may be directly coupled to the voltage inputs of the voltage controlled frequency generators 410 and thus control the number of pulses per time duration results in the percent light brightness desired from each of the RGB LEDs without regard to the pulse train on-time average. This arrangement produces open loop brightness control for each of the RGB LEDs.

Figure 5:
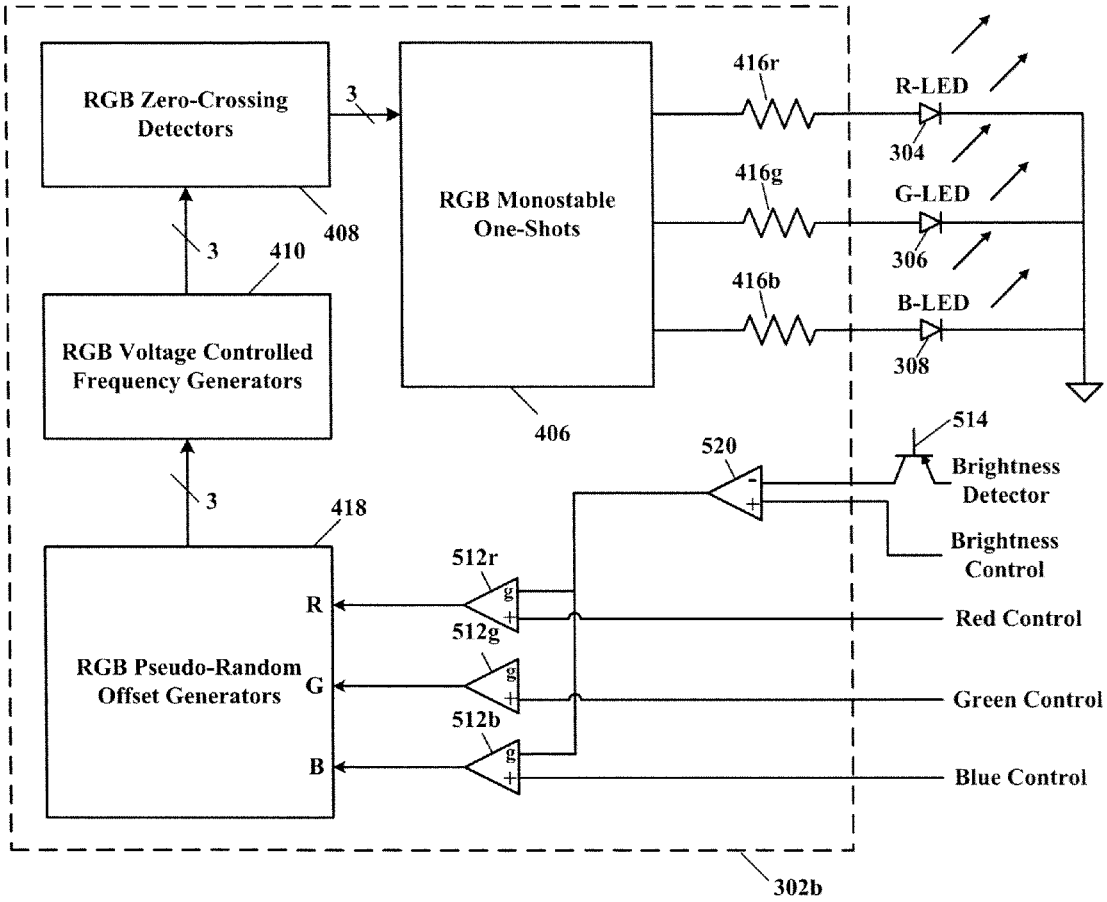
FIG. 5 is a schematic block diagram of VFM pulse generators driving a three-element RGB-LED combination, according to another specific example embodiment of this disclosure.

Referring to FIG. 5, depicted is a schematic block diagram of VFM pulse generators driving a three-element RGB-LED combination, according to another specific example embodiment of this disclosure. VFM pulse generators 302*b* comprise RGB monostable one-shots 406 having fixed pulse width (logic high time duration) outputs, amplifiers 512 having controllable gains, voltage controlled frequency generators 410, zero-crossing detectors 408, a brightness detector 514, and differential amplifier 520 for controlling the gains of the amplifiers 512. Each of the one-shots 406 is "fired" (output goes to a logic high for the fixed time duration) whenever a start pulse at its respective input is detected. These start pulses are supplied from the zero-crossing detectors 408 at repetition rates (pulses per time duration) which are determined from the frequencies of the voltage controlled frequency generators 310. The voltage controlled frequency generators 410 may be voltage controlled oscillators (VCOs), voltage-to-frequency converters, etc. Resistors 416 may be used to control the amount of current to the red LED 304, the green LED 306 and the blue LED 308.

The output signal frequencies from the voltage controlled frequency generators 410 are controlled by voltages from the respective gain controlled amplifiers 512. The gain controlled amplifiers 512 receive red, green and blue control signal inputs for desired colors to be generated, and the gains of the gain controlled amplifiers 512 are controlled by an output from the differential amplifier 520. A light brightness control signal is received at the positive input and a light brightness (intensity) detected signal is received at the negative input of the differential amplifier 520. The light brightness (intensity) detected signal voltage from the light intensity detector 514 is representative of the combined color brightness from the red LED 304, green LED 306 and blue LED 308. The amplifiers 512 having gain controlled by differential amplifier 520, will cause the voltage controlled frequency generators 410 to adjust their frequencies so that the combined color brightness from the red LED 304, green LED 306 and blue LED 308 equals the light brightness control voltage input (voltage levels configured to be proportional to desired percent of the combined color brightness). This arrangement produces a closed loop brightness control for the combined color brightness from the red LED 304, green LED 306 and blue LED 308. An advantage of this configuration is that the pulses may be adjusted to compensate for light brightness output degradation of the red LED 304, green LED 306 and blue LED 308.

According to the teachings of this disclosure, an optional further feature may use pseudo-random offset generators 418 to introduce random voltage perturbations at the voltage inputs of the voltage controlled frequency generators 410. These pseudo-random voltage perturbations may further spread EMI noise power over a greater (wider) number of frequencies, and thus reduce the EMI noise power at any one frequency over time. This is very advantageous when having to meet strict EMI radiation standards. The pseudo random offset generators 418 may be coupled between the voltage inputs of the voltage controlled frequency generators 410 and the outputs of the gain controlled amplifiers 512. Only one pseudo random offset generator 418 required if coupled between the light brightness control signal line and input to the operational amplifier 520, the light brightness detector 514 and the other input of the operational amplifier 520, or between the output of the operational amplifier 520 and the gain control inputs of the amplifiers 512. The pseudo-random offset generator(s) 418 may provide additional frequencies to those frequencies resulting from the combination of the light intensity closed loop control and output from the light brightness detector 514.

Figure 6:
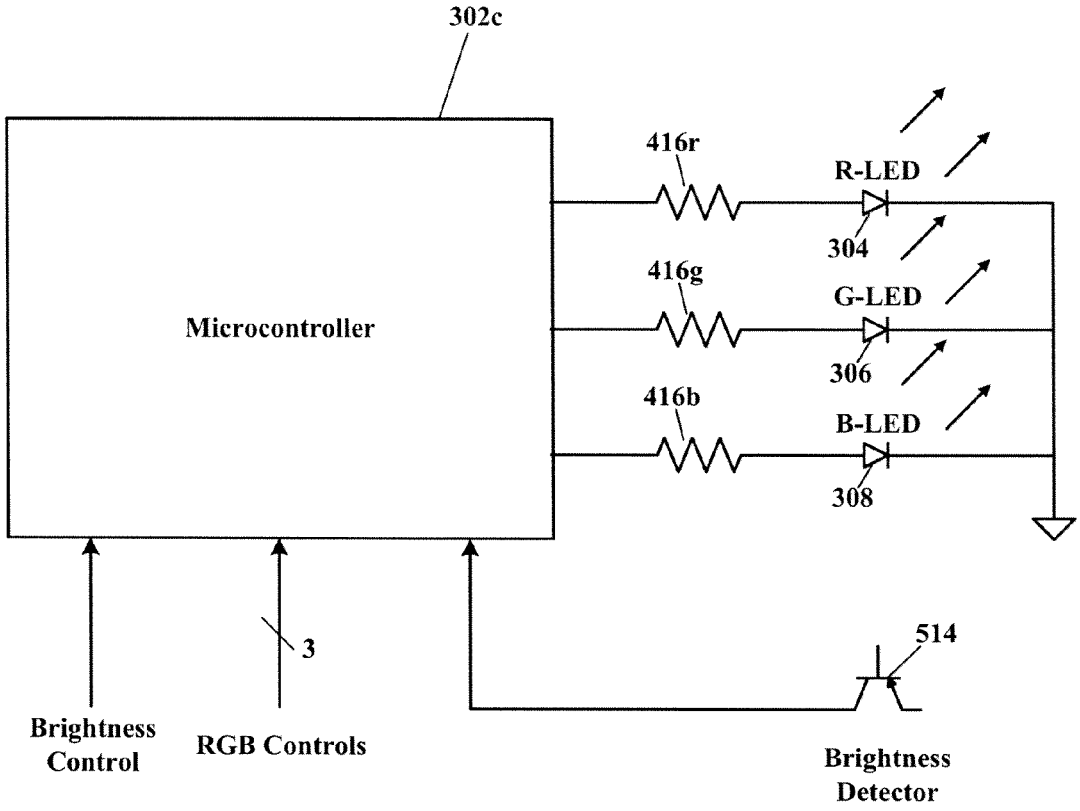
FIG. 6 is a schematic block diagram of a microcontroller configured and programmed to function as VFM pulse generators driving a three-element RGB-LED combination, according to yet another specific example embodiment of this disclosure.

Referring to FIG. 6, depicted is a schematic block diagram of a microcontroller configured and programmed to function as VFM pulse generators driving a three-element RGB-LED combination, according to yet another specific example embodiment of this disclosure. A microcontroller 302*c* may be configured as RGB VFM pulse generators for driving the red LED 304, green LED 306 and blue LED 308. The microcontroller 302*c* may have analog and/or digital inputs for control of color (RGB), color intensity (brightness) and light intensity (brightness) detection from a light intensity detector 514. The microcontroller 302*c* generates the fixed pulse width (logic high time duration) outputs that drive the red LED 304, green LED 306 and blue LED 308 through the current limiting resistors 416 with a software program. The number of fixed width pulses per time duration (frequency) are also controlled with the software program running in the microcontroller 302*c*.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. An apparatus for controlling brightness and color from a grouping of red, green and blue light emitting diodes (LEDs), comprising:

red, green and blue pulse generating circuits having trigger inputs and pulse outputs, wherein a plurality of trigger signals are applied to each of the trigger inputs and a plurality of pulses therefrom are generated at each of the red, green and blue pulse outputs, wherein each of the plurality of pulses has a constant width and amplitude;

red, green and blue pulse on-time integrators, each having a pulse input coupled to a respective pulse output of the red, green and blue pulse generating circuits and an integration time interval input, wherein the red, green and blue pulse on-time integrators generate output voltages proportional to percentages of when the amplitudes of the plurality of pulses for each of the red, green and blue pulse outputs are on over an integration time interval;

red, green and blue operational amplifiers, each having negative and positive inputs and an output, each of the negative inputs is coupled to the output voltage from a respective one of the red, green and blue pulse on-time integrators and each of the positive inputs of the red, green and blue operational amplifiers is coupled to voltage signals representing desired color and light brightness from red, green and blue light emitting diodes (LEDs); and red, green and blue voltage controlled frequency generators having frequency control inputs and frequency outputs, wherein each of the frequency control inputs is coupled to a respective output of the red, green and blue operational amplifiers, and the frequency outputs generating the plurality of the trigger signals are coupled to the trigger inputs of the red, green and blue pulse generating circuits, whereby the red, green and blue voltage controlled frequency sources cause the red, green and blue pulse generating circuits to produce the plurality of pulses necessary for producing the desired color and light brightness from the red, green and blue LEDs.

2. The apparatus according to claim 1, wherein the red, green and blue LEDs are coupled to the red, green and blue pulse outputs, respectively, of the red, green and blue pulse generating circuits.

3. The apparatus according to claim 2, wherein the red, green and blue LEDs are coupled to the red, green and blue pulse outputs, respectively, of the red, green and blue pulse generating circuits through current limiting resistors.

4. The apparatus according to claim 1, further comprising red, green and blue zero-crossing detectors coupled between respective ones of the trigger inputs of the red, green and blue pulse generating circuits and the red, green and blue frequency outputs of the red, green and blue voltage controlled frequency generators, wherein the plurality of trigger signals are generated from the red, green and blue zero-crossing detectors.

5. The apparatus according to claim 1, further comprising red, green and blue pseudo-random offset generators coupled between respective ones of the red, green and blue outputs of the red, green and blue pulse on-time integrators and respective ones of the negative inputs of the red, green and blue operational amplifiers.

6. The apparatus according to claim 1, further comprising red, green and blue pseudo-random offset generators coupled between respective ones of the red, green and blue outputs of the red, green and blue operational amplifiers and respective ones of the frequency control inputs of the red, green and blue voltage controlled frequency generators.

7. The apparatus according to claim 1, further comprising red, green and blue pseudo-random offset generators coupled between respective ones of the positive inputs of the red, green and blue operational amplifiers and the red, green and blue voltage signals representing the desired brightness of each of the red, green and blue LEDs.

8. The apparatus according to claim 1, wherein the red, green and blue voltage controlled frequency generators are voltage controlled oscillators.

9. The apparatus according to claim 1, wherein the red, green and blue voltage controlled frequency generators are voltage-to-frequency converters.

10. An apparatus for controlling brightness and color from a grouping of red, green and blue light emitting diodes (LEDs), comprising:

red, green and blue pulse generating circuits having trigger inputs and pulse outputs, wherein a plurality of trigger signals are applied to each of the trigger inputs and a plurality of pulses therefrom are generated at each of the red, green and blue pulse outputs, wherein each of the plurality of pulses has a constant width and amplitude;

a light brightness detector adapted to receive colored light from red, green and blue light emitting diodes (LEDs) and output a voltage proportional to the color light brightness therefrom;

a brightness control operational amplifier having a negative input coupled to the light brightness detector and a positive input coupled to a voltage signal representing a desired color light brightness from the red, green and blue LEDs;

red, green and blue gain controlled amplifiers, each having a respective signal input coupled to red, green and blue control signals representing desired color and light brightness from the red, green and blue light LEDs, and a gain control input coupled to an output of the brightness control operational amplifier; and red, green and blue voltage controlled frequency generators having frequency control inputs and frequency outputs, wherein each of the frequency control inputs is coupled to a respective output of the red, green and blue gain controlled amplifiers, and the frequency outputs generating the plurality of the trigger signals are coupled to the trigger inputs of the red, green and blue pulse generating circuits, whereby the red, green and blue voltage controlled frequency sources cause the red, green and blue pulse generating circuits to produce the plurality of pulses necessary for producing the desired color and light brightness from the red, green and blue LEDs.

11. The apparatus according to claim 10, wherein the red, green and blue LEDs are coupled to the red, green and blue pulse outputs, respectively, of the red, green and blue pulse generating circuits.

12. The apparatus according to claim 11, wherein the red, green and blue LEDs are coupled to the red, green and blue pulse outputs, respectively, of the red, green and blue pulse generating circuits through current limiting resistors.

13. The apparatus according to claim 10, further comprising red, green and blue zero-crossing detectors coupled between respective ones of the trigger inputs of the red, green and blue pulse generating circuits and the red, green and blue frequency outputs of the red, green and blue voltage controlled frequency generators, wherein the plurality of trigger signals are generated from the red, green and blue zero-crossing detectors.

14. The apparatus according to claim 10, further comprising red, green and blue pseudo-random offset generators coupled between respective ones of the red, green and blue outputs of the red, green and blue pulse on-time integrators and respective ones of the negative inputs of the red, green and blue gain controlled amplifiers.

15. The apparatus according to claim 10, further comprising red, green and blue pseudo-random offset generators coupled between respective ones of the red, green and blue outputs of the red, green and blue gain controlled amplifiers and respective ones of the frequency control inputs of the red, green and blue voltage controlled frequency generators.

16. The apparatus according to claim 10, further comprising red, green and blue pseudo-random offset generators coupled between respective ones of the positive inputs of the red, green and blue gain controlled amplifiers and the red, green and blue voltage signals representing the desired brightness of each of the red, green and blue LEDs.

17. The apparatus according to claim 10, wherein the red, green and blue voltage controlled frequency generators are voltage controlled oscillators.

18. The apparatus according to claim 10, wherein the red, green and blue voltage controlled frequency generators are voltage-to-frequency converters.

19. A microcontroller for controlling brightness and color from a grouping of red, green and blue light emitting diodes (LEDs), comprising:

a microcontroller having red, green and blue outputs, a brightness control input and red, green and blue control inputs, the red, green and blue outputs are coupled to the red, green and blue light emitting diodes (LEDs), the brightness control input is coupled to a color light brightness control signal and the red, green and blue control inputs are coupled to red, green and blue control signals; and the microcontroller generates red, green and blue control signals, each control signal comprising a plurality of pulses, wherein each control signal comprises a plurality of time periods and is modulated to vary the number of pulses that are present in each time period and wherein each of the plurality of pulses within a respective red, green, and blue control signal has a constant width and amplitude, and light brightness from each of the red, green and blue LEDs is proportional to a percent of time that the plurality of constant width and amplitude red, green and blue pulses are on over an integration time interval.

20. The microcontroller according to claim 19, wherein the microcontroller generating the plurality of pulses at pseudo-random frequencies.

* * * * *